United States Patent [19]

Hosaka et al.

[11] 4,359,670

[45] Nov. 16, 1982

[54] LAMP INTENSITY CONTROL APPARATUS COMPRISING PRESET MEANS

[75] Inventors: Masao Hosaka; Nobuyuki Yanagawa, both of Tokyo, Japan

[73] Assignee: Ricoh Company, Ltd., Tokyo, Japan

[21] Appl. No.: 200,689

[22] Filed: Oct. 27, 1980

[30] Foreign Application Priority Data

Nov. 1, 1979 [JP] Japan ..... 54-141653

[51] Int. Cl.[3] ..... H05B 39/08

[52] U.S. Cl. ..... 315/307; 315/135; 315/199; 315/291; 315/293; 315/DIG. 4

[58] Field of Search ..... 315/129, 133, 135, 136, 315/194, 199, 291–293, 307, 311, DIG. 4; 355/69; 364/480

[56] References Cited

U.S. PATENT DOCUMENTS

| | | | |
|---|---|---|---|
| 3,968,401 | 7/1976 | Bryant | 315/293 |
| 3,990,000 | 11/1976 | Digneffe | 315/292 X |
| 4,249,111 | 2/1981 | Gluck | 355/69 X |

*Primary Examiner*—Eugene La Roche
*Attorney, Agent, or Firm*—David G. Alexander

[57] ABSTRACT

Push buttons (9*u*, 9*d*) are provided to select the desired intensity of a lamp (1) for electrostatic copying or the like. The selected intensity is numerically displayed. A preset function is provided to preset the intensity to a standard value when power is first applied to the apparatus. The intensity may thereafter be manually varied using the push buttons (9*u*, 9*d*). The lamp intensity is controlled by means of phase angle control of a thyristor (2). Provision is made to compensate the phase angle control for variations in the A.C. power supply voltage.

7 Claims, 11 Drawing Figures

LAMP INTENSITY CONTROL APPARATUS COMPRISING PRESET MEANS

BACKGROUND OF THE INVENTION

The present invention relates to a system for controlling the intensity of light which an exposing lamp emits to illuminate an original document in an image reading apparatus or a copying machine.

In an image reading apparatus or a copying machine, the light intensity of the illuminating lamp affects the image processing quality and image signal reading, and, in a copying operation, the image signal level, contrast and recording density. Such apparatus is thus designed to allow adjustment of the light intensity so as to match it with the properties of images of different original documents. A halogen lamp usable as an exposing lamp has a light intensity which varies in proportion to the 3.8th power of the voltage of a power source. Therefore, the source voltage is another factor which has influence on the image processing quality. To solve this problem, a prior art control system employs a thyristor such as a TRIAC connected in series with a halogen lamp, the lamp having a rating on the order of 80 V. This system makes the power supply voltage (effective value) about 80 V by controlling the power supply phase angle of the thyristor and automatically controls the phase angle of the power supply by advancing the phase when the source voltage drops and retarding it when the source voltage rises. Usually, an apparatus for such control is provided with a volume control (variable resistor) and a discrete circuit. The volume control is furnished with graduations indicating recording densities or light intensities for example. The discrete circuit employs a voltage corresponding to the phase angle selected through the volume control as its target value and shifts the phase angle in the advancing direction when the source voltage drops, shifts it in the retarding direction when the source voltage rises and triggers the TRIAC when the phase of the source voltage coincides with the phase angle. It is usual to use an analog discrete circuit partly because the indication output of the volume control is an analog signal and partly because the source voltage is analog.

This type of lamp control system involves various disadvantages. First, despite the fact that the volume control is manipulatable steplessly throughout its predetermined range, such fine adjustment is reflected only by insignificant differences in the actual results of image processing. This makes untrained operators feel it rather troublesome to select a specific position of the volume control. Second, after one operator used a copying machine or a facsimile transceiver with an image scanning device with a certain setting of the volume control, the next operator may happen to use it without altering the volume control setting. Where the volume control setting by the first operator is excessive for a document which the second operator intends to process, the resultant image will be poor in quality and the second operator will thus be required to copy or transmit the same document again after re-setting the volume control. A possible expendient for solving this problem is a resetting mechanism which, using a ball latch hving a spring biased steel ball for example, restrains the rotation of the volume control with a certain magnitude of force (the magnitude being such that it permits rotation for adjustment but overcomes the spring force which tends to return the volume control) while the power source is being turned on. After the power source has been turned off or just after the turning on of the power source, the resetting mechanism returns the volume control to its standard position by the action of the spring. However, this mechanism is very intricate in construction and needs a large number of parts and a large space. Generally, the standard position mentioned is an intermediate point in the adjustable range of the volume control or its neighborhood and, hence, the resetting mechanism requires a complex arrangement capable of returning the volume control in the opposite direction to the standard position. This objectionable in view of the fact that, in recent years, an increase in the number of mechanical elements costs more and involves a larger loss in space than an increase in the number of electric and electronic elements.

SUMMARY OF THE INVENTION

A power supply apparatus for applying power to a lamp embodying the present invention is characterized by comprising input means for designating a selected light intensity of the lamp, display means for displaying the selected light intensity, control means for controlling an effective voltage applied to the lamp in such a manner that the lamp produces the selected light intensity, and preset means for, when power is initially applied to the apparatus, presetting the input means to designate a predetermined selected light intensity, the input means being thereafter manually operable to designate the selected light intensity.

In accordance with the present invention, push buttons are provided to select the desired intensity of a lamp for electrostatic copying or the like. The selected intensity is numerically displayed. A preset function is provided to preset the intensity to a standard value when power is first applied to the apparatus. The intensity may thereafter be manually varied using the push buttons. The lamp intensity is controlled by means of phase angle control of a thyristor. Provision is made to compensate the phase angle control for variations in the A.C. power supply voltage.

In accordance with the present invention, major control elements of the system comprise digital elements or chips. A power supply phase angle is selected through a key input while, at the instant the power source is turned on, the major elements determine a standard phase angle. The use of a microcomputer for the digital elements permits substantially all of the necessary controls such as calculating and setting a phase and setting the standard phase angle. Where a 1-chip microcomputer of the type having AC input terminals and capable of AC voltage detection and zero-cross detection is employed, the control system can have its cost cut down and many of its circuits and elements omitted.

A primary object of the present invention is to provide an exposing lamp control system having a resetting function which does not rely on additional mechanical elements such as those of a resetting mechanism.

Another object of the present invention is to provide an exposing lamp control system which offers digital display of values corresponding to power supply phase angles, e.g. recording densities.

Still another object of the present invention is to construct an exposing lamp control system by using a digital electronic device which is relatively inexpensive and needs only a relatively small space.

It is another object of the present invention to provide a generally improved lamp intensity control apparatus.

Other objects, together with the foregoing, are attained in the embodiments described in the following description and illustrated in the accompanying drawing.

DESCRIPTION OF THE PREFERRED EMBODIMENTS

While the lamp intensity control apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
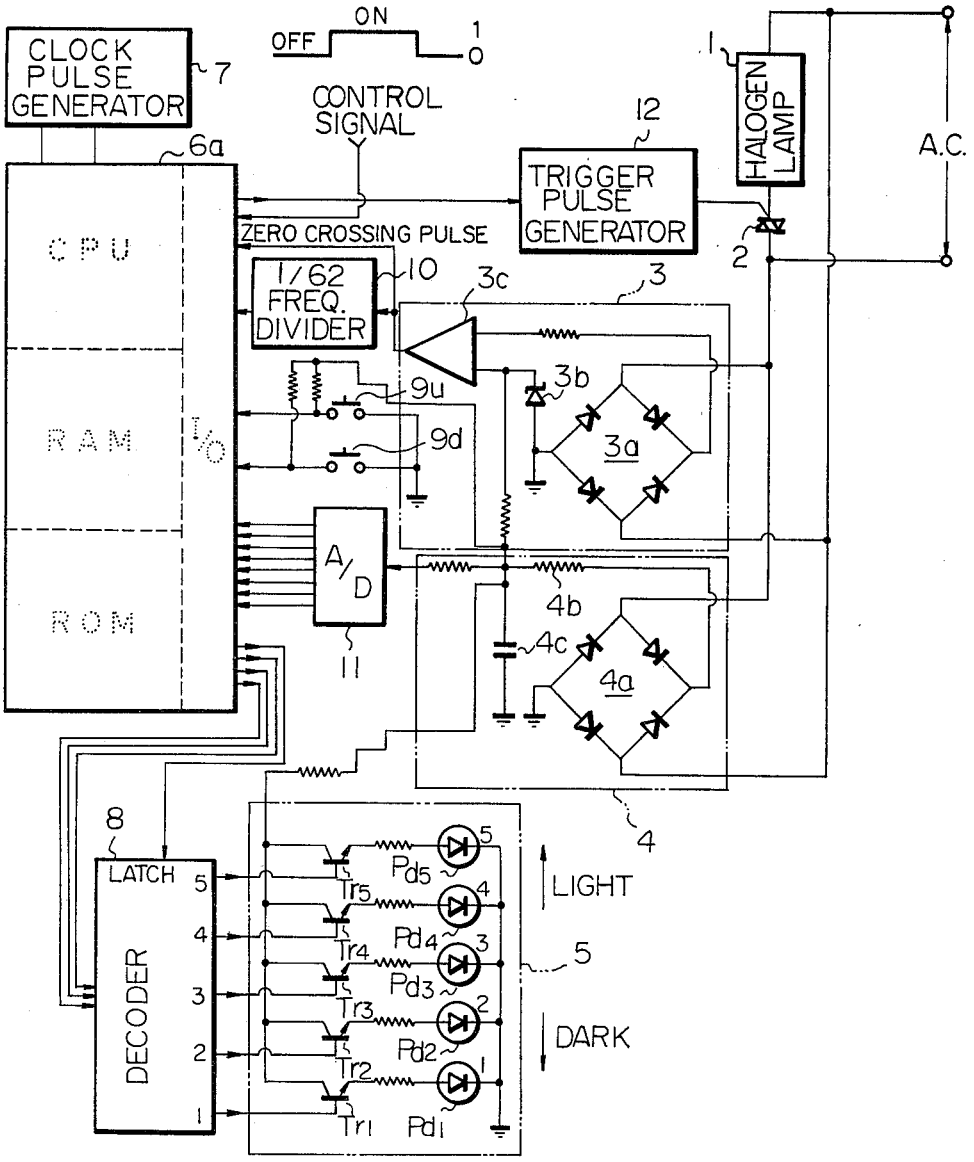
FIG. 1 is an electrical schematic diagram, partially in block form, of a lamp intensity control apparatus embodying the present invention.

Referring to FIG. 1, a control system according to the present invention is shown which is of the type employing an ordinary 1-chip microcomputer 6*a*. The reference numeral 1 denotes a lamp for exposure in the form of a halogen lamp, 2 a TRIAC (bidirectional thyristor), 3 a zero-cross detection circuit, 4 a voltage detection circuit, and 5 a display unit.

The zero-cross detector 3 comprises a full-wave rectifying bridge 3*a*, Zener diode 3*b* and comparator 3*c*. A pulsating output voltage of the bridge 3*a* is coupled to one input terminal of the comparator 3*c* while a breakdown voltage (constant) of the Zener diode 3*b* is coupled to the other input terminal of the comparator 3*c*. When the output voltage of the bridge 3*a* is lower than the breakdown voltage of the Zener diode 3*b*, that is, in a narrow range above and below the zero phase of the AC input, the comparator 3*c* produces a high level or "1" pulse which is a zero-cross detection pulse. Where the frequency of an AC power source A.C. is 50 Hz, the zero-cross detection pulse will have a frequency of 100 Hz. This pulse is applied directly to the I/O port of the microcomputer 6*a* and, at the same time, to a 1/62 frequency divider 10. The frequency divider 10 then supplies the I/O port of the microcomputer 6*a* with a pulse whose frequency is $100/62 \approx 1.6$ Hz.

The voltage detector 4 is made up of a full-wave rectifying bridge 4*a* and a resistor 4*b* and capacitor 4*c* for smoothing. The capacitor 4*c* couples its voltage to an analog-to-digital or A/D converter 11 which in turn converts the input voltage into a digital 8-bit code and supplies it to the I/O port of the microcomputer 6*a*.

Further connected to the I/O port of the microcomputer 6*a* are a control signal line for commanding energization of the lamp 1 (high or "1" level) and key switches 9*u* and 9*d* for setting a phase. The I/O port is connected to the input terminal of a trigger pulse generator 12 and also to input terminals of a decoder 8. The decoder 8 is supplied with a code corresponding to a selected phase and produces a high or "1" level output at its one output line corresponding to the input code. In this embodiment, phases to be selected are determined as indicated in Table 1 shown below while the lamp 1 has its brightness varied in stages 1-5 corresponding to the individual phases.

TABLE 1

| PHASE | | SELECTED LIGHT INTENSITY | | TARGET LAMP VOLTAGE | |
|---|---|---|---|---|---|
| DECIMAL | BINARY | DECIMAL | BINARY | V | BINARY |
| 24 | 00011000 | 5 | 00000101 | 84 | 01010100 |
| 44 | 00101100 | 4 | 00000100 | 78 | 01001110 |
| 54 | 00110100 | 3 | 00000011 | 68 | 01000100 |
| 60 | 00111100 | 2 | 00000010 | 62 | 00111110 |
| 64 | 01000000 | 1 | 00000001 | 52 | 00110100 |

Z

If the selected phase is "24", the decoder 8 will produce a "1" output at its output terminal 5. Likewise, if the selected phase is from "44" to "64", a corresponding one of the other output terminals 4-1 will become "1" in level. The "1" outputs at the output terminals 5-1 of the decoder individually furn on transistors $Tr_5$-$Tr_1$ of display unit 5 which in turn energize corresponding light emitting diodes $Pd_5$-$Pd_1$. Light emitted from the diodes $Pd_5$-$Pd_1$ is visible from the outside through a light transmitting plate on which numerals "5" to "1" indicating the intensities of light are printed. In the illustrated embodiment, the standard light intensity on the display unit 5 is "3" designated by the phase "54".

Figures 1, 2A:
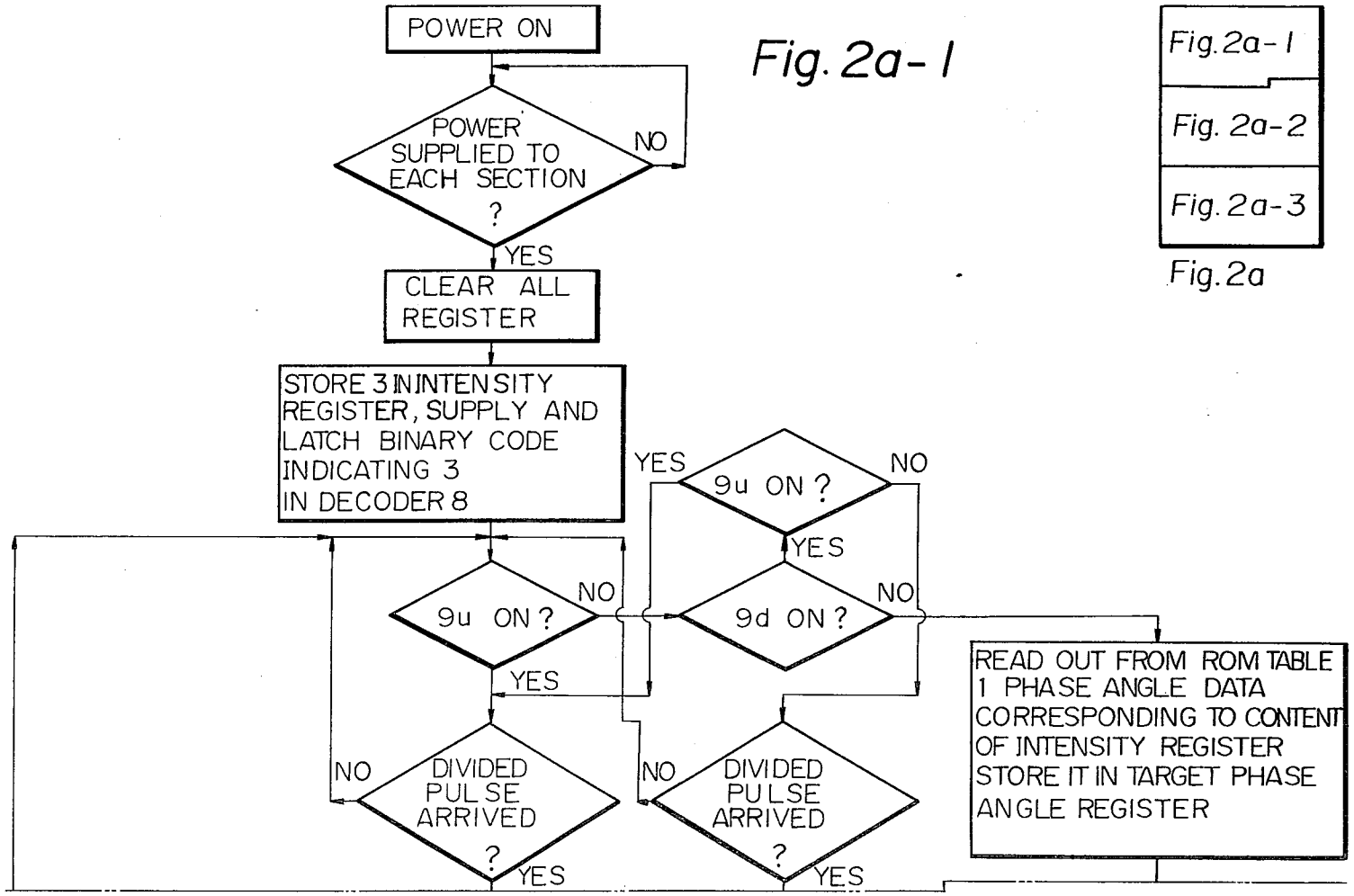
FIGS. 2*a* and 2*b* are flowcharts illustrating the operation of the embodiment of FIG. 1.
Figures 2, 2A:
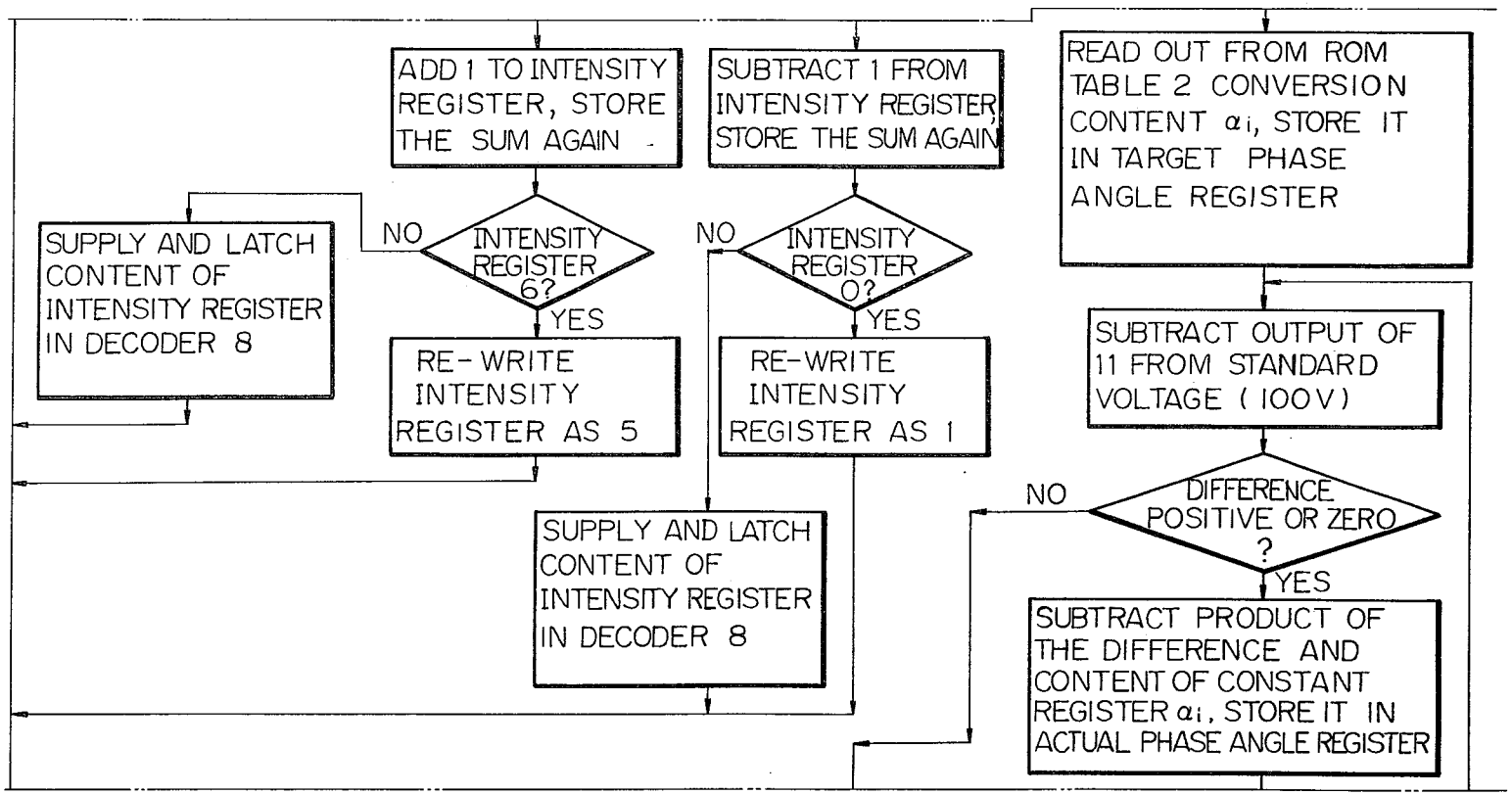

When supplied with power, the microcomputer 6*a* clears its semiconductive read and write or random access memory RAM and resets its latch. Then the microcomputer 6*a* supplies power to individual sections on the basis of program data stored in a read only memory ROM. Also, the microcomputer 6*a* sets and controls the power supply phase in response to a control signal, manipulation of the key switches 9*u* and 9*d* and an output code of the A/D converter 11 with reference to an output pulse of a pulse oscillator 7 and a zero-cross pulse. Settings of the ROM of the microcomputer 6*a* and actions based thereon will be discussed with reference to the flow charts of FIGS. 2*a* and 2*b*.

For the convenience of description, fixed numerical data regions stored in the ROM will be referred to as "tables" whereas data reading and writing regions in the RAM will be referred to as "registers". The tables and registers are herein supposed to be arranged as shown in Table 2.

TABLE 2

| TABLES & REGISTERS | DATA STORED |
|---|---|
| ROM Table 1 | Phase angles 62–24 for light intensities 1–5 |
| ROM Table 2 | voltage-phase angle conversion constants $\alpha_1$–$\alpha_5$ |
| Intensity Register | light intensities 1–5 selectable by 9u and 9d |
| Target Phase Angle Register | data read out from ROM Table 1 |
| Constant Register | data read out from ROM Table 2 |
| Actual Phase Angle Register | control phase angle data |

Upon supply of power to the microcomputer 6*a*, the microcomputer 6*a* awaits the completion of power supply to individual sections of the apparatus and then clears the RAM, stores "3 (011)" in the intensity register and latches the code "011" in the decoder 8. This causes the light emitting diode $Pd_3$ of the display unit 5 to turn on and indicate the light intensity "3". Then the microcomputer 6*a* determines the states of the key switches 9*u* and 9*d*. If the key switch 9*u* is closed, the microcomputer 6a up-counts a 1.6 Hz frequency divided pulse when the latter arrives thereat. That is, the microcomputer 6a adds "1" to the content of the intensity register and replaces the existing data therein with the sum. The display 5 can accomodate "1" to "5", and intensities beyond this range cannot be set. Hence, when the count or content of the intensity register becomes "6" or larger, the content of the intensity register is re-written as "5" with any further counting inhibited. When the content of the intensity register is altered, the altered version is coupled to and latched again in the decoder 8. In this way, while the key switch 9u is in its closed state, the content of the intensity register increments "1" every time a frequency divided pulse is supplied thereto and the display 5 advances successively toward "5". When and after the display 5 has reached "5", the content of the intensity register is no longer altered and the display 5 does not change any further.

When the key switch 9d is found closed and if the other key switch 9u is open, the microcomputer 6a down-counts the frequency divided pulses so that the content of the intensity register decrements one by one causing the display 5 to shift toward "1". After the display 5 has reached "1", the content of the intensity register and, therefore, the display 5 no longer vary. When both of the key switches 9d and 9u are closed, the microcomputer 6a up-counts the pulses to progressively increment the content of the intensity register. This is because the microcomputer 6a is so designed as to read the closed state of the key switch 9u before that of the key switch 9d.

With the above program data, an operator closes either one of the switches 9d and 9u and then open it looking at the display "1" to "5" whereby the desired light intensity is loaded in the intensity register and indicated on the display 5. When neither the switch 9d nor the switch 9u is closed, "3" will be displayed because the content of the intensity register is "3".

Where both of the key switches 9u and 9d are open or when they are opened from their closed states, the microcomputer 6a reads the ROM table 1 with the content of the intensity register as an address and in this way reads out phase angle data corresponding to the existing content of the intensity register. This phase angle data is stored in the target phase angle register. Then the microcomputer 6a reads a voltage-phase angle conversion constant $\alpha_i$(i=1, 2, . . . 5) corresponding to the specific phase angle data out of the ROM table 2 and stores it in the constant register. The constant $\alpha_1$ indicates an amount of phase angle shift necessary for varying the voltage by a unit amount (e.g. 1 V) in the phase control in the neighborhood of each target phase angle (62-24 in Table 1) which corresponds to a light intensity i.

The microcomputer 6a reads the standard level of the voltage of the AC power source (e.g. 100 V) out of the ROM. The actual voltage (output of the A/D converter 11) is subtracted from the standard voltage and the difference dV obtained is multiplied by the content $\alpha_1$ of the constant register. When this product is positive or zero (the actual AC voltage is equal to or lower than the standard voltage), a compensatory phase $dV.\alpha_1$ is subtracted from the content of the target phase angle register (to advance the angle) and the difference is stored in the actual phase angle register. If the actual AC voltage is higher than the standard voltage, the product $dV.\alpha_1$ is negative and, therefore, its absolute value is added to the content of the target phase angle register (to retard the angle) and the sum is stored in the actual phase angle register.

Then the microcomputer 6a awaits the arrival of a control signal "1" which is a lamp-ON command and, until it arrives, repeats the operations discussed above for checking the states of the key switches 9u and 9d, reading and loading data and correcting the phase.

Upon supply of a "1" control signal, the microcomputer 6a loads in a counter of its internal logic unit (CPU) the content of the actual phase angle register which is the phase angle data corrected in accordance with the actual source voltage. At the instant a zero-cross detection pulse arrives at the microcomputer 6a, the phase angle counter mentioned above starts down-counting timing pulses at a rate of about 180 pulses per half cycle of the source voltage. As the phase angle counter produces a carry output indicating that the phase of the source voltage has coincided with the content of the actual phase angle register, the microcomputer supplies a trigger command signal to the trigger pulse generator 12. Then the TRIAC 2 becomes conductive at the phase indicated by the data in the actual phase angle register and, thereafter, regains the non-conductive state at a phase $n\pi$(n=1, 2, 3, . . . ). After the supply of the trigger command signal, the microcomputer 6a advances to a flow © of FIG. 2a for subtracting the actual voltage (output of the A/D converter 11) from the standard voltage (100 V). In this flow, the microcomputer 6a as described above calculates a phase angle $dV.\alpha_i$ necessary for cancelling the difference between the standard and actual source voltages, stores the corrected phase angle data again in the actual phase angle register, loads it in the phase angle counter, and awaits the arrival of a zero-cross pulse. In the manner described, the microcomputer 6a corrects the target phase angle in accordance with the actual voltage fluctuation and thereby controls the conducting phase of the TRIAC 2 while the control signal is "1" level. A substantially 90° or longer time interval (approximately 5 msec or longer in the case of 50 Hz) is available from the instant the trigger command signal is delivered to the instant the zero-cross pulse arrives. By the end of this time interval, the microcomputer 6a will have completed the procedure in the flow © from the calculation of the voltage difference up to loading of the phase angle data in the phase angle counter.

It is only when the control signal "0" level that the closed states of the key switches 9u and 9d are read and, since the data in the decoder 8 is altered during this period, the display 5 does not move while the lamp 1 is being turned on. When the power source is turned off and then on again, "3" will be loaded first in the intensity register. This means a marked decrease in the probability that the next operator of the apparatus will operate it with a light intensity other than the standard (the value set by the last operator).

Recently, 1-chip microcomputers have come to be available quite cheaply. Among such microcomputers, the Intel 8022 has two A/D converter channels, a zero-cross point detection terminal, testing terminals $T_0$ and $T_1$, three ports of input/output terminals, 2K bytes of ROM and 128 bytes of RAM all together on one chip. The use of this type of microcomputer as the microcomputer 6a permits the zero-cross detector 3 and A/D converter 11 to be omitted outside the chip as viewed in FIG. 3.

Figures 2, 2A, 3:
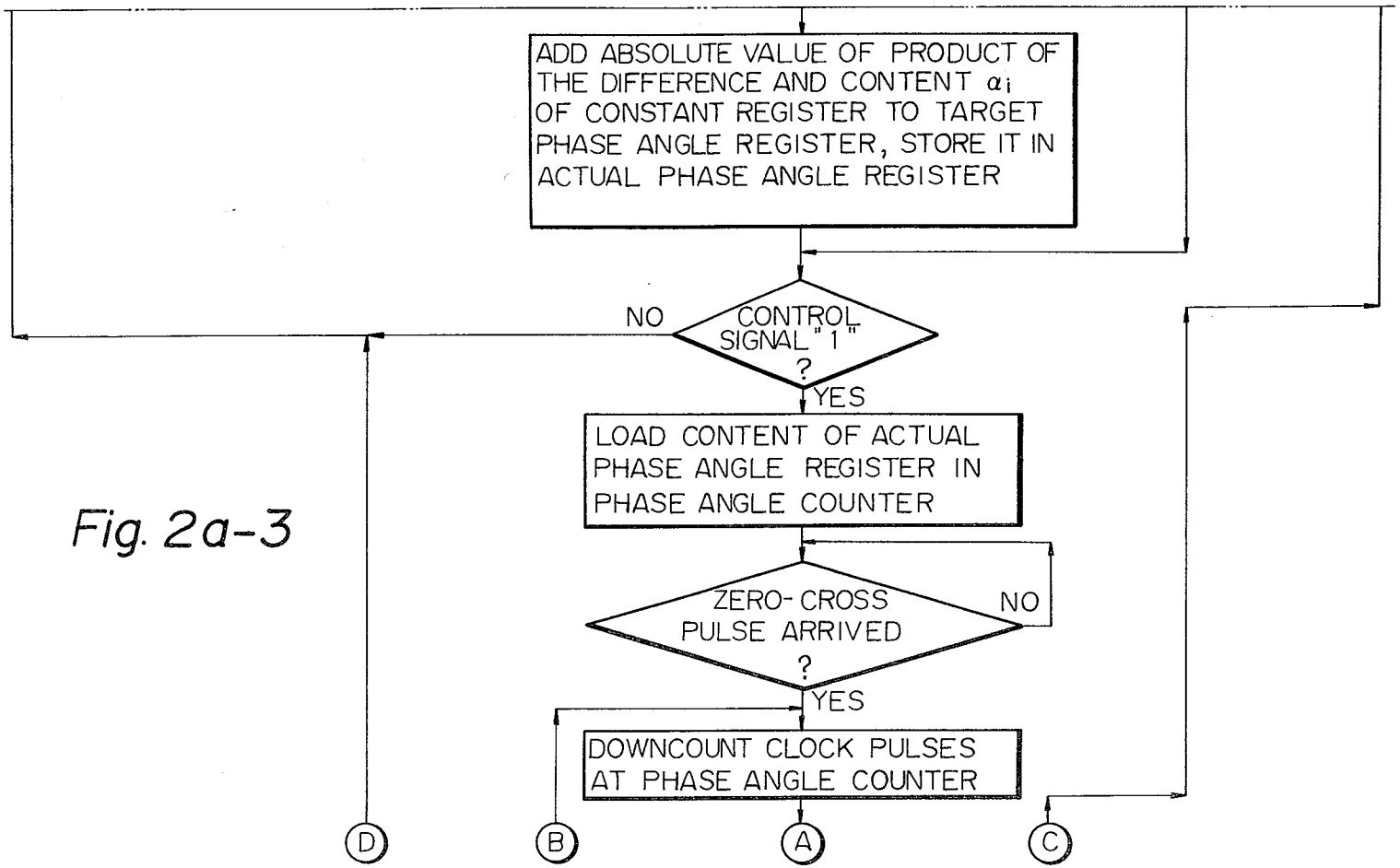
FIGS. 3 and 4 are similar to FIG. 1 but illustrate further embodiments of the present invention.
Figure 2B:
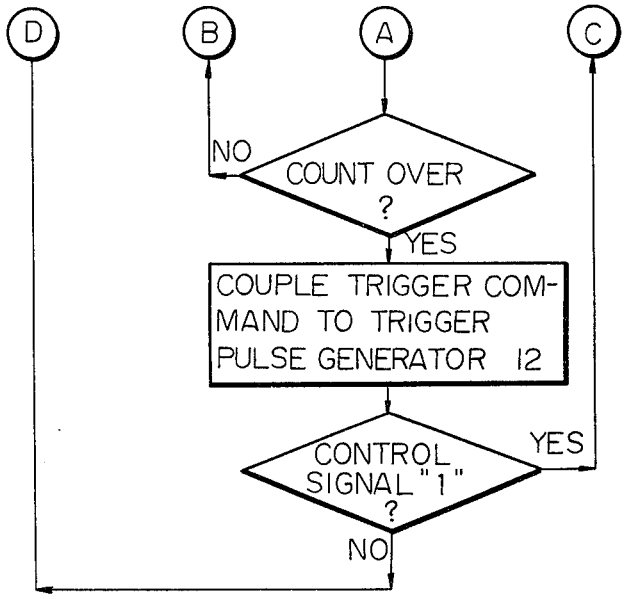
Figure 3:
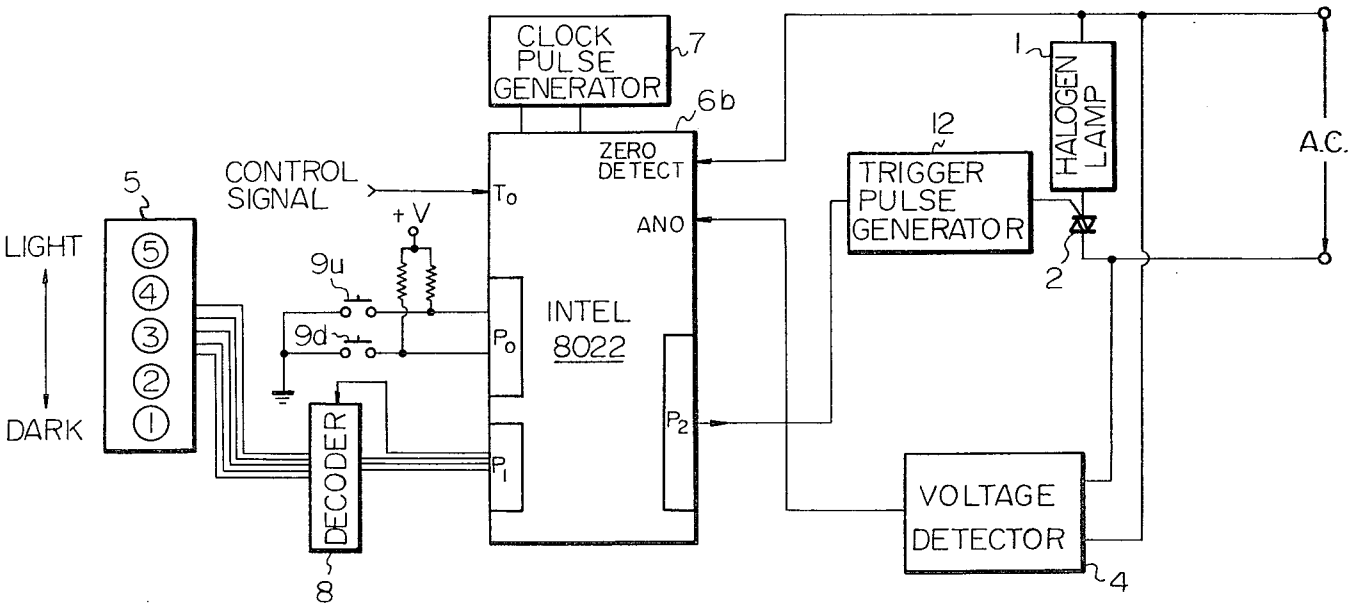

Referring to FIG. 3, a microcomputer 6b employing the Intel 8022 receives an output analog voltage of the rectifier smoother 4 at its analog input terminal ANO. The voltage introduced in the microcomputer 6b through the terminal ANO is converted within the chip into an 8-bit digital code based on a program. The chip 6b detects the zero-crossing of the AC voltage coupled to its Zero Detect input terminal and, with this as a reference, determines the trigger phase timing. As for the light intensity when the key switches 9u and 9d are closed, the chip 6b determines it by preparing pulses with an invert counter formed within the CPU. A control signal is applied to the testing terminal $T_0$ of the chip 6b and read by 2-byte commands JNTO and JTO. If the control signal is "1", the lamp 1 will turn on. The other controls are similar to those discussed in connection with the first embodiment. It will thus be understood that the use of the Intel 8022 reduces the number of necessary elements outside the ship and thereby promotes easy wiring and a decrease in the necessary space for installation.

Figure 4:
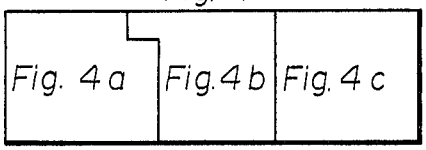
Figure 4A:
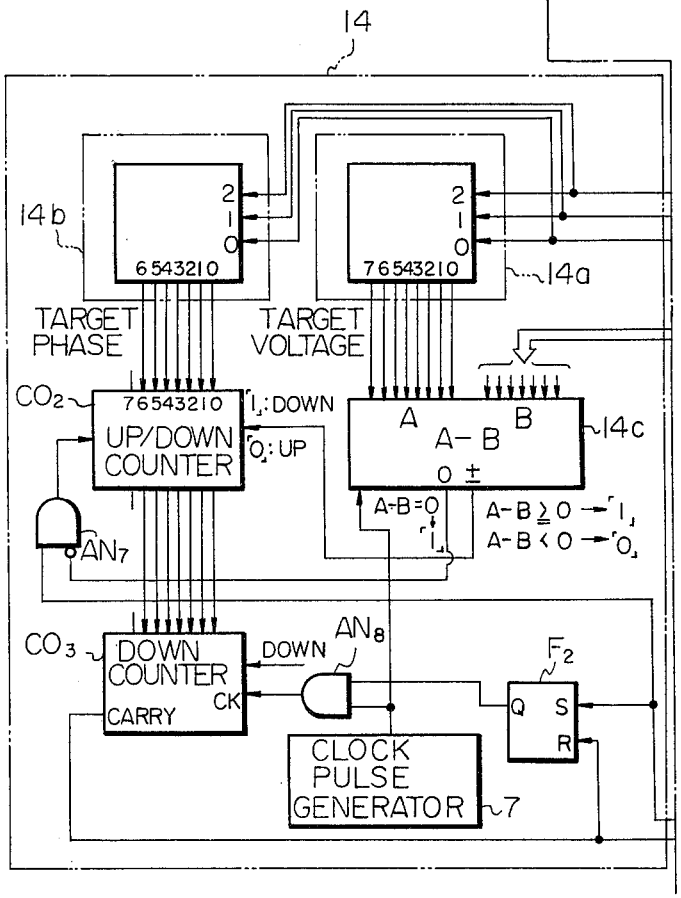
Figure 4B:
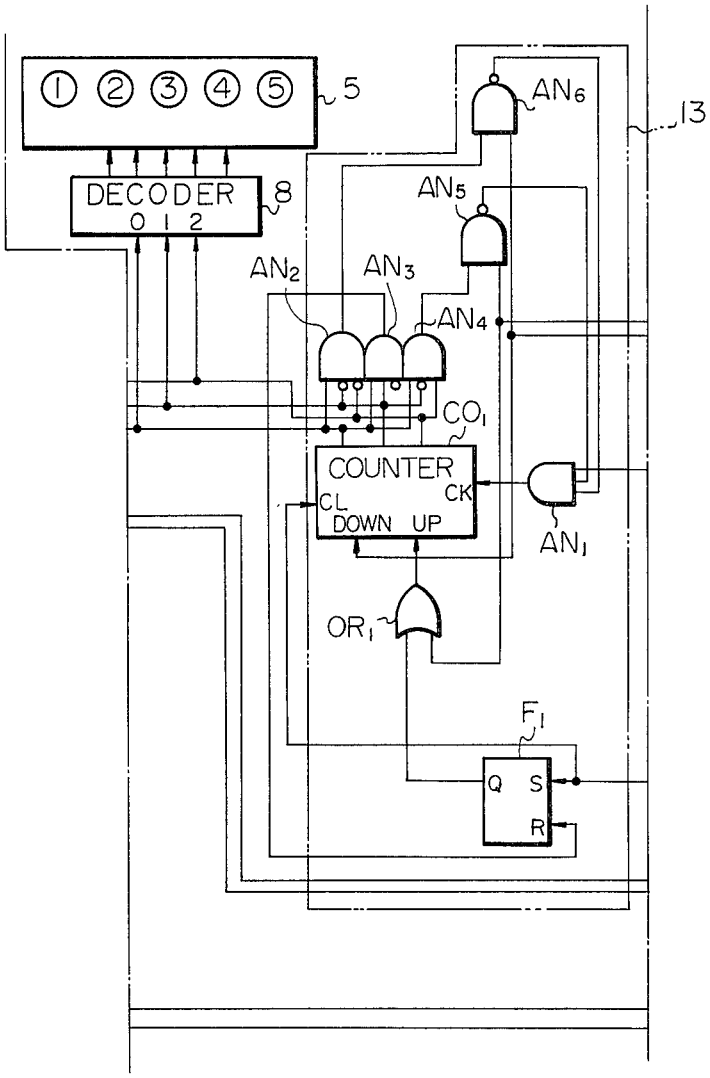
Figure 4C:
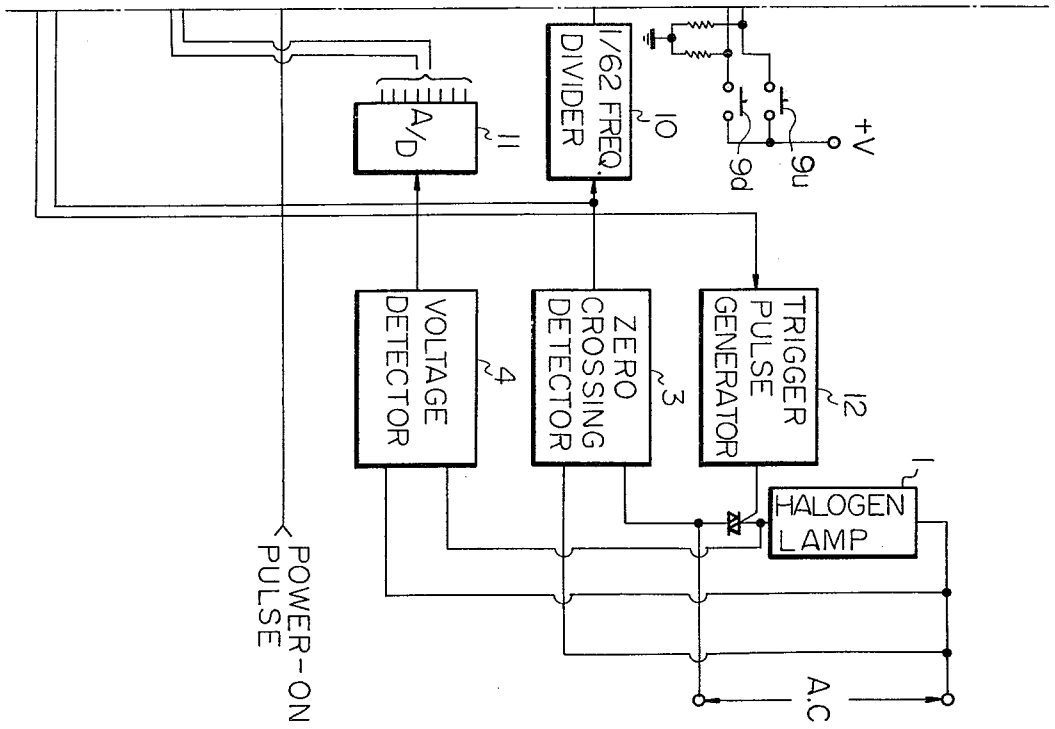

FIG. 4 illustrates another embodiment of the invention which employs digital elements having relatively simple functions. The circuitry of FIG. 4 includes a target phase angle setting section 13 and a phase correction or compensation control section 14 which in combination constitute an electronic control system according to the invention. After the power source has been turned on and power connected to the entire circuitry shown in FIG. 4, a power-ON pulse arrives at the system. Then, in the target phase angle setting section 13, a flip-flop F1 is set to make its Q output "1" so that a count-up command is delivered through an OR gate OR1 to a counter CO1. When frequency divided pulses are coupled to the counter CO1 through an AND gate AN1, the counter CO1 counts up. As the count of the counter CO1 reaches "3", an AND gate AN3 produces a "1" output which resets the flip-flop F1 and thereby cancels the count-up command. The count of the counter CO1 therefore remains "3". In this way, every time a power-ON pulse is supplied to the circuitry, the count code of the counter CO1 becomes "011" indicating "3" and the standard light intensity is set. The counter CO1 is supplied with a count-up command signal when the key switch 9u is closed and with a count-down command signal when the key switch 9d is closed. The counter CO1 up- or down-counts the input pulses in accordance with such states of the key switches 9u and 9d. When the count of the counter CO1 is "5", an AND gate AN4 produces a "1" output. When the count is "1", an AND gate AN2 produces a "1" output. If the key switch 9u is in the closed state when the AND gate AN4 has produced the "1" output, the inverted output of an AND gate AN5 becomes "0" thereby closing the AND gate AN1. If on the other hand the key switch 9d is in the closed state when the AND gate AN2 has produced the "1" output, the inverted output of an AND gate AN6 becomes "0" whereby the AND gate AN1 is closed to interrupt the passage of frequency divided pulses to the counter CO1. Thus, also in this embodiment, when the key switch 9u is closed, the counter CO1 stops counting up when the count reaches "5". When the key switch 9d is closed, the count-down stops at count "1". The count code is applied to the decoder 8 and one numeral corresponding to the count code is indicated on the display unit 5.

The count code from the counter CO1 is also supplied to the phase correction control section 14. In this section, an encoder 14a processes the input count code into a binary code which indicates a selected voltage according to Table 1. The binary code is coupled from the encoder 14a to a chip 14c for subtraction (addition of a supplement). This code designated A in the drawing is the code indicative of the selected target voltage. The other code B is in this embodiment an output binary code of the A/D converter 4 and which indicates a voltage actually applied to the lamp 1. Subtracting the code B from the code A at a given time, the chip 14c produces signals representing whether the difference $A-B$ is positive, negative or $A=B$ respectively. If $A=B$, the chip 14c supplies a "1" output to the inverting input terminal of an AND gate AN7. If $A \neq B$, a "0" output is supplied to the same. The chip 14c delivers a down-count command signal to a counter CO2 if $A-B \geqq 0$ and an up-count command signal if $A-B<0$. Furthermore, the output count code of the counter CO1 is passed to an encoder 14b and thereby converted into a binary code indicating the selected phase on the basis of the relation shown in Table 1. This binary code is loaded in the counter CO2. Every time a zero-cross pulse arrives, the counter CO2 counts up (when $A \neq B$ and $A-B<0$) or down (when $A \neq B$ and $A-B \geqq 0$) from the present value and loads its output code in a counter CO3. More specifically, the counter CO2 will count up if the actual voltage applied to the lamp 1 is higher than the target voltage and count down if otherwise. This value in the counter CO2 after the up- or down-count is the amount of phase correction and the content of the counter CO2 given by addition or subtraction of the phase correction amount is loaded in the counter CO3. The counter CO3 is constantly supplied with a down-count command signal. A flip-flop F2 is set by a zero-cross pulse coupled thereto and makes its Q output "1" whereby an AND gate AN8 is opened to pass phase timing clock pulses (outputs of the pulse generator 7) therethrough to the counter CO3. Then this counter CO3 down-counts from the preloaded value and, when the count reaches zero, it produces a carry pulse to reset the flip-flop F2 and close the AND gate AN8. The carry pulse is coupled to the trigger pulse generator 12 as a trigger command signal. Every time a zero-cross pulse is supplied, the down-counting operation occurs in the counter CO3 and a trigger command signal appears.

In this embodiment, the trigger phase is corrected by detecting the actual voltage applied to the lamp 1 and causing the counter CO2 down-count or up-count until the actual voltage reaches the target voltage. The encoders 14a and 14b may comprise read-only memories or wired diode logic elements.

As a modification to the embodiment of FIG. 4, there may be designed circuitry in which the digital phase correction control 14 and A/D converter 11 are omitted and, instead, a known analog control unit is installed which controls the conduction of a thyristor on the basis of a target phase value and a source voltage. With this circuit design, the output code of the counter CO1 will be processed by an A/D converter into an analog voltage and applied to the analog control unit while the output of the rectifier/smoother 4 will be also coupled to the analog control unit.

Furthermore, the logic in FIG. 4 for the detection of the voltage actually applied to the lamp 1 and the phase shift which will occur until the actual voltage reaches the target voltage may be employed for the embodiment of FIG. 1 or 3 with or without modification.

In summary, a lamp control system according to the present invention minimizes the probability of mis-setting of the brightness because the brightness or phase angle of thyristor triggering is necessarily reset every time the power source is turned on. Additionally, since the brightness of the lamp is selectable in digital manner by manipulation of keys, the handling is easy and the space required for the component elements is small and the apparatus as a whole is relatively economical. These advantages will become particularly prominent when use is made of a microcomputer chip.

Various modifications will become possible for those skilled in the art after receiving the teachings of the present disclosure without departing from the scope thereof.

What is claimed is:

1. A power supply apparatus for applying power to a lamp, characterized by comprising:

input means for designating a selected light intensity of the lamp;

display means for displaying the selected light intensity;

control means for controlling an effective voltage applied to the lamp in such a manner that the lamp produces the selected light intensity;

preset means for, when power is initially applied to the apparatus, presetting the input means to designate a predetermined selected light intensity, the input means being thereafter manually operable to designate the selected light intensity; and an A.C. power source for applying said power to the apparatus and switch means connected in series with the lamp across the A.C. power source, the control means being constructed to control the switch means to control the effective A.C. voltage applied to the lamp in such a manner that the lamp produces the selected light intensity;

the switch means comprising a thyristor, the control means being constructed to control a phase angle of a trigger signal applied to the thyristor;

the control means comprises means for detecting a zero-cross point of an A.C. output voltage of the A.C. power source, counter means for counting clock pulses starting from said zero-cross point and means for generating the trigger signal when a count of the counter means reaches a value corresponding to the selected light intensity.

2. An apparatus as in claim 1, in which the input means comprises push buttons.

3. An apparatus as in claim 1, in which the control means and preset means are constituted by a microcomputer.

4. An apparatus as in claim 1, further comprising compensation means for compensating the phase angle of the trigger signal for deviation of the output voltage of the A.C. power supply from a predetermined value.

5. An apparatus as in claim 4, in which the compensation means is constructed to sense the A.C. output voltage and compensate the phase angle of the trigger signal in accordance therewith.

6. An apparatus as in claim 4, in which the compensation means is constructed to sense the effective A.C. voltage and compensate the phase angle of the trigger signal in accordance therewith.

7. An apparatus as in claim 4, in which the control means is constituted by a 1-chip microcomputer having input port means for receiving the A.C. output voltage of the A.C. power supply and means for detecting zero-cross points thereof.

* * * * *